US008113626B2

(12) United States Patent
Mizoguchi

(10) Patent No.: US 8,113,626 B2
(45) Date of Patent: Feb. 14, 2012

(54) RECORDING APPARATUS AND RECORDING APPARATUS MANUFACTURING METHOD

(75) Inventor: Yuji Mizoguchi, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 385 days.

(21) Appl. No.: 12/402,057

(22) Filed: Mar. 11, 2009

(65) Prior Publication Data

US 2009/0231393 A1 Sep. 17, 2009

(30) Foreign Application Priority Data

Mar. 13, 2008 (JP) ..... 2008-064012

(51) Int. Cl.
*B41J 2/14* (2006.01)

(52) U.S. Cl. ..... 347/47

(58) Field of Classification Search ..... 347/20, 347/40, 47

See application file for complete search history.

(56) References Cited

U.S. PATENT DOCUMENTS

| | | | | |
|---|---|---|---|---|
| 6,412,903 | B1 * | 7/2002 | Lee et al. | 347/19 |
| 6,450,614 | B1 * | 9/2002 | Scheffelin et al. | 347/42 |
| 7,156,481 | B2 * | 1/2007 | Matsuba et al. | 347/17 |
| 2005/0001868 | A1 | 1/2005 | Matsuba et al. | |
| 2005/0001877 | A1 | 1/2005 | Chikanawa et al. | |
| 2005/0001881 | A1 | 1/2005 | Nakashima et al. | |

FOREIGN PATENT DOCUMENTS

| | | | |
|---|---|---|---|
| JP | 2004-322606 | A | 11/2004 |
| JP | 2005-088206 | A | 4/2005 |
| JP | 2006-264188 | A | 10/2006 |
| JP | 2008-012747 | A | 1/2008 |
| JP | 2008-036512 | A | 2/2008 |

OTHER PUBLICATIONS

Japan Patent Office; Notice of Reasons for Rejection in Japanese Patent Application No. 2008-064012 (counterpart to the above-captioned U.S. patent application) mailed Apr. 13, 2010.

* cited by examiner

*Primary Examiner* — An Do
(74) *Attorney, Agent, or Firm* — Baker Botts L.L.P.

(57) ABSTRACT

A recording apparatus includes a first recording head. The first recording head includes a first nozzle plate. The first nozzle plate includes a first group of nozzle holes and a first positioning hole configured to position the first recording head. A second recording head is adjacent to the first recording head in a first direction. The second recording head includes a second nozzle plate. The second nozzle plate includes a second plurality of nozzle holes and a second positioning hole configured to position the second recording head. The first positioning hole and the second positioning hole are aligned in a straight line extending in the first direction.

13 Claims, 7 Drawing Sheets

RECORDING APPARATUS AND RECORDING APPARATUS MANUFACTURING METHOD

CROSS REFERENCE TO RELATED APPLICATION

This application claims priority from Japanese Patent Application No. 2008-064012, which was filed on Mar. 13, 2008, the disclosure of which is incorporated herein by reference in its entirety.

BACKGROUND OF THE INVENTION

1. Field of the Invention

The invention relates generally to a recording apparatus for recording an image on a recording medium by ejecting droplets and a method for manufacturing the recording apparatus.

2. Description of Related Art

A known inkjet printer includes a plurality of inkjet heads arranged, such that the inkjet heads partially overlap one another in the conveying direction, e.g., staggered in a scanning direction perpendicular to the conveying direction. In the known inkjet printer, the inkjet heads are positioned with reference to the positions of the nozzles arranged in the overlapping regions of the inkjet heads, or, with reference to alignment marks formed in the ink ejection surfaces of the inkjet heads.

In the known inkjet printer, the nozzles formed in the inkjet heads are spaced apart from one another by a distance equal to the print resolution in the scanning direction. Therefore, the nozzles formed in overlapping regions of the inkjet heads are not arranged in a straight line extending in the conveying direction. Thus, it is difficult to position adjacent inkjet heads in the conveying direction with reference to the positions of their nozzles.

SUMMARY OF THE INVENTION

A need has arisen for a recording apparatus capable of accurately and easily positioning the recording heads.

According to an embodiment of the invention, a recording apparatus comprises a first recording head and a second recording head. The first recording head comprises a first nozzle plate. The first nozzle plate comprises a first plurality of nozzle holes and a first positioning hole configured to position the first recording head. The second recording head is adjacent to the first recording head in a first direction. The second recording head comprises a second nozzle plate. The second nozzle plate comprises a plurality of nozzle holes and a second positioning hole configured to position the second recording head. The first positioning hole and the second positioning hole are aligned in the first direction.

According to another embodiment of the invention, a recording apparatus comprises a plurality of recording heads arranged adjacent to one another in a first direction. Each of the recording heads comprises a nozzle plate. Each nozzle plate comprises a plurality of nozzle holes and at least one positioning hole configured to position the plurality of recording heads. A first positioning hole formed in a first nozzle plate of a first recording head and a second nozzle hole formed in a second nozzle plate of a second recording head adjacent to the first recording head are aligned in the first direction.

According to yet another embodiment of the invention, a recording apparatus manufacturing method comprises the steps of arranging a first recording head and a second recording head adjacent to the first recording head in a first direction.

Each of the first and the second recording heads comprises a nozzle plate which comprises a plurality of nozzle holes, at least one detection hole, and at least one positioning hole configured to position the recording heads. The manufacturing method further comprises the steps of attaching the first and the second recording heads to the recording apparatus, determining the positions of a first positioning hole of the first recording head and a second positioning hole of the second recording head, detecting the positions of the first and the second positioning holes with reference to the at least one detecting hole of each of the first and the second recording head, confirming the positions of the first and the second positioning holes, and positioning the first and the second inkjet heads, such that the first and the second positioning holes are aligned in the first direction.

Other objects, features, and advantages of the invention will be apparent to persons of ordinary skill in the art in view of the foregoing detailed description of the invention and the accompanying drawings.

BRIEF DESCRIPTION OF THE DRAWINGS

For a more complete understanding of the invention, the needs satisfied thereby, and the objects, features, and advantages thereof, reference now is made to the following description taken in connection with the accompanying drawings.

DETAILED DESCRIPTION OF EMBODIMENTS

Embodiments of the invention and their features and technical advantages may be understood by referring to FIGS. 1-8, like numerals being used for like corresponding portions in the various drawings. References to the "right" or "left" side refer to opposite sides consistent with the orientation of the referenced figure.

Figure 1:
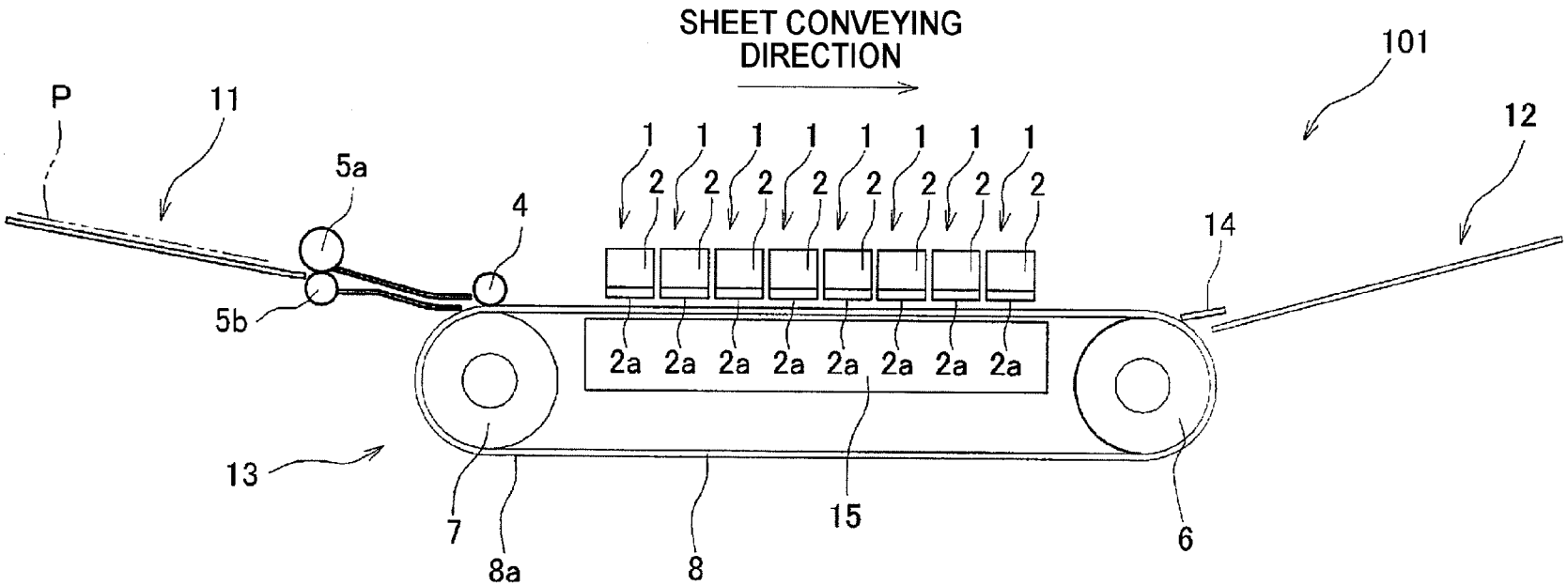
FIG. 1 is a side view of an inkjet printer according to an embodiment of the invention.

Referring to FIG. 1, an inkjet printer 101, e.g., a color inkjet printer, may comprise a plurality of inkjet heads 1, e.g., eight, inkjet heads 1. Inkjet printer 101 may comprise a sheet feeding part 11 on the left side, a sheet discharging part 12 on the right side, and a sheet conveying path extending from sheet feeding part 11 to sheet discharging part 12 for conveying a sheet P, as shown in FIG. 1.

A plurality of feed rollers, e.g., feed rollers 5*a* and 5*b*, may nip and convey sheet P, and may be disposed at the downstream side of sheet feeding part 11 in a sheet conveying direction. Feed rollers 5*a* and 5*b* may feed sheet P from sheet feeding part 11 in the sheet conveying direction, e.g., toward the right in FIG. 1. A conveying mechanism 13 may be disposed in sheet conveying path 11. Conveying mechanism 13 may comprise a plurality of belt rollers, e.g., belt rollers 6 and 7; an endless conveying belt 8 that wraps and moves around belt rollers 6 and 7; and a platen 15 positioned in a region surrounded by conveying belt 8. Platen 15 may support conveying belt 8 at a position opposite to the positions of inkjet heads 1 to prevent conveying belt 8 from sagging downward. A nip roller 4 may be disposed at a position opposite belt roller 7. Nip roller 4 may press sheet P fed from feed rollers 5*a* and 5*b* onto an outer circumference 8*a* of conveying belt 8.

When a conveying motor (not shown) rotates belt roller 6, conveying belt 8 may convey sheet P from nip roller 4 to sheet discharging part 12, and may hold sheet P with a weak adhesive force on the surface of conveying belt 8 during the sheet conveying process. The surface of conveying belt 8 may comprise a weak-adhesive, silicon resin layer.

A separating mechanism 14 may be disposed on the downstream side of conveying belt 8 in the sheet conveying direction. Separating mechanism 14 may separate sheet P from outer circumference 8*a* of conveying belt 8 and may guide sheet P to sheet discharging part 12.

Figure 2:
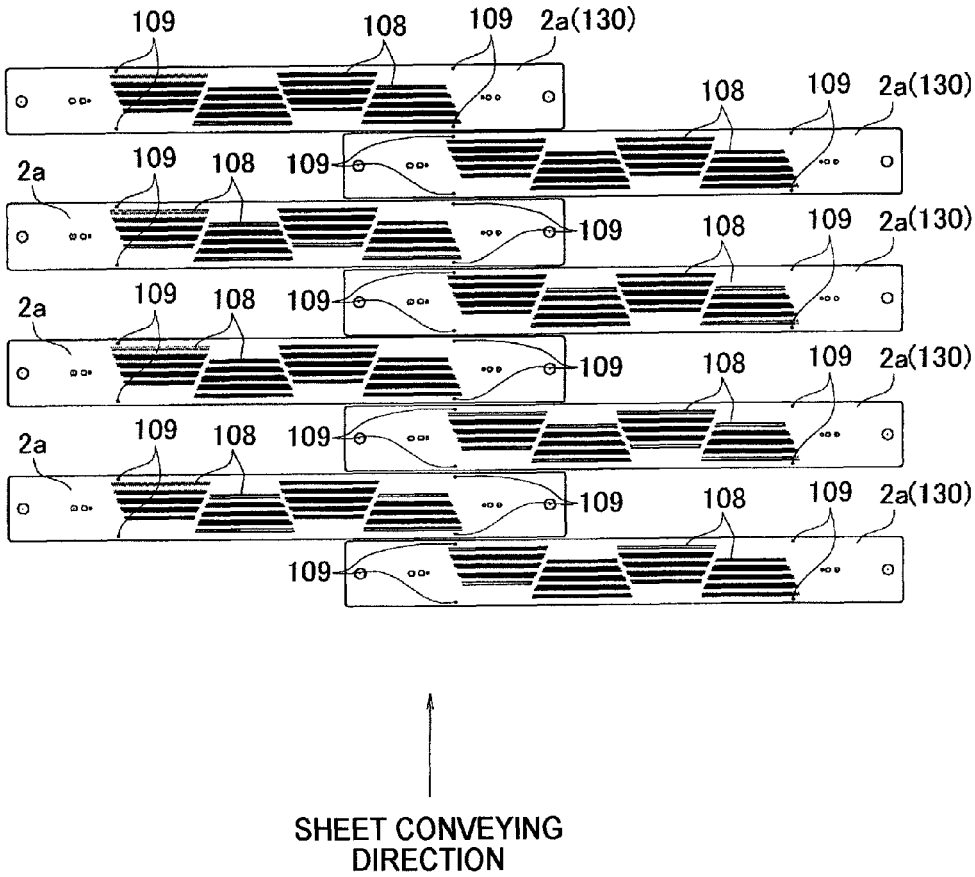
FIG. 2 is a plan view of inkjet heads according to an embodiment of the invention.

Referring to FIG. 2, inkjet heads 1 may have a substantially rectangular-parallelepiped shape, elongated in a direction, e.g., main scanning direction, perpendicular to the sheet conveying direction, e.g., the direction from the bottom to the top in FIG. 2. A plurality of inkjet heads 1, e.g., eight inkjet heads 1, may be arranged, such that the inkjet heads alternately reverse orientation in the sheet conveying direction. Inkjet heads 1 may be arranged in an alternately reversed manner in the sheet conveying direction. Two adjacent inkjet heads 1 in the sheet conveying direction may comprise an inkjet head pair. A plurality of inkjet head pairs, e.g., four inkjet head pairs, may be arranged in the sheet conveying direction. Each of the plurality of inkjet head pairs may correspond to one of a plurality of colors of ink, e.g., magenta, yellow, cyan, and black. Each inkjet head 1 may eject ink droplets of its corresponding color.

Two inkjet heads 1 of each inkjet head pair may be disposed, so that the pair of inkjet heads partially overlap each other in the sheet conveying direction and are offset from each other in the main scanning direction. The length of the ejection area of an inkjet head pair in the main scanning direction may be greater than the width of sheet P. Inkjet printer 101 may be a line printer. In another embodiment, a plurality of inkjet heads 1 may be aligned linearly in the sheet conveying direction, without offset from each other in the main scanning direction.

Referring to FIGS. 1 and 2, inkjet heads 1 may comprise head bodies 2 at their lower ends, e.g., the portion of the inkjet heads closest to the conveying belt. The lower surfaces of head bodies 2 may comprise ink ejection surfaces 2*a* which are disposed opposite from outer circumference 8*a*. Ink ejection surfaces 2*a* may be disposed at the lower surfaces of nozzle plates 130. Each of ink ejection surfaces 2*a* may comprise a plurality of nozzle holes 108. Nozzle holes 108 may be arranged at a pitch of 600 dpi in the main scanning direction. When the sheet P conveyed by conveying belt 8 passes below the plurality of head bodies 2, ink droplets of various colors may be ejected from ink ejection surfaces 2*a* onto a top surface, e.g., print surface, of sheet P. In this way, a desired color image may be formed on the print surface of sheet P.

Figure 3:
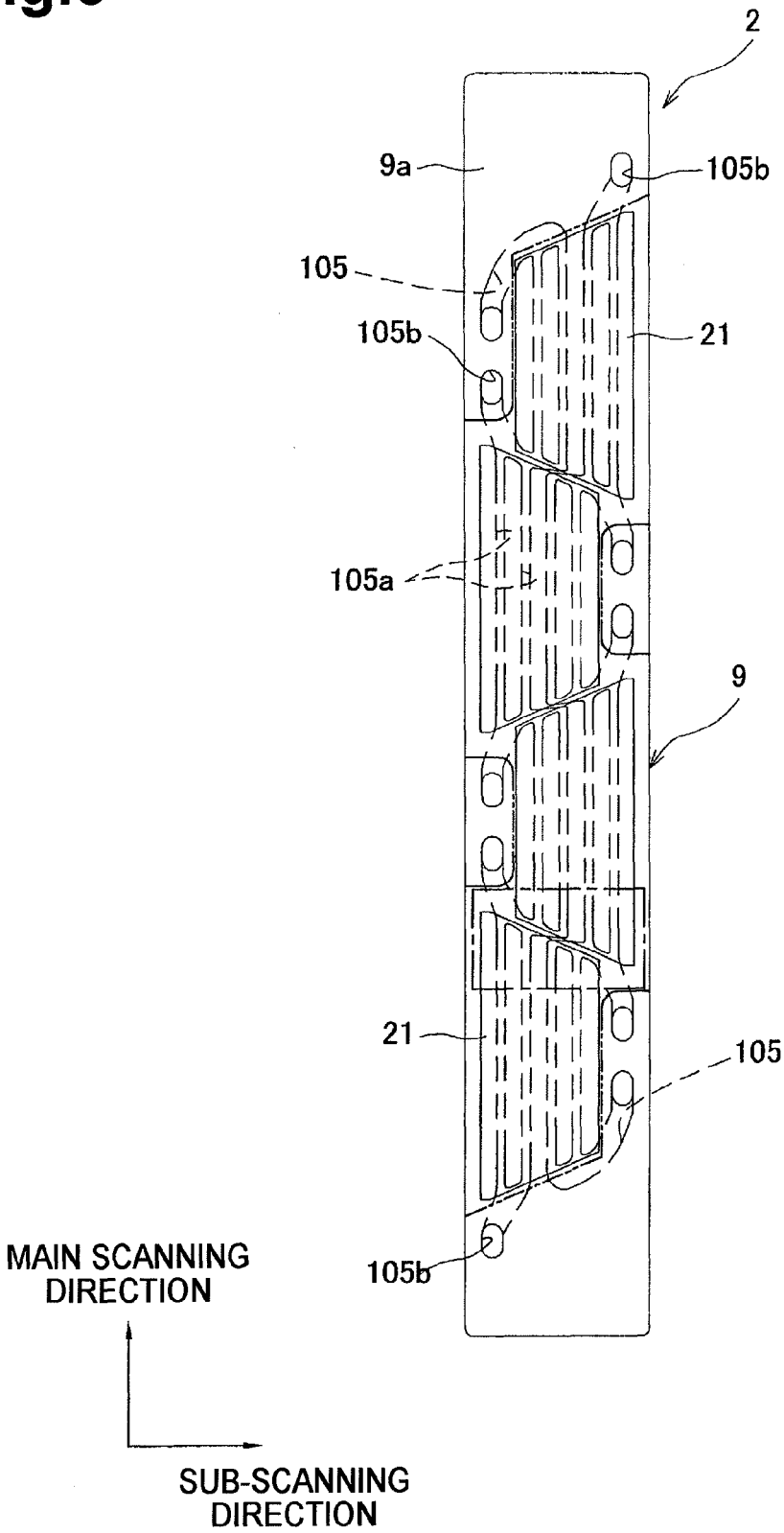
FIG. 3 is a plan view of a head body according to the embodiment of FIG. 2.
Figure 4:
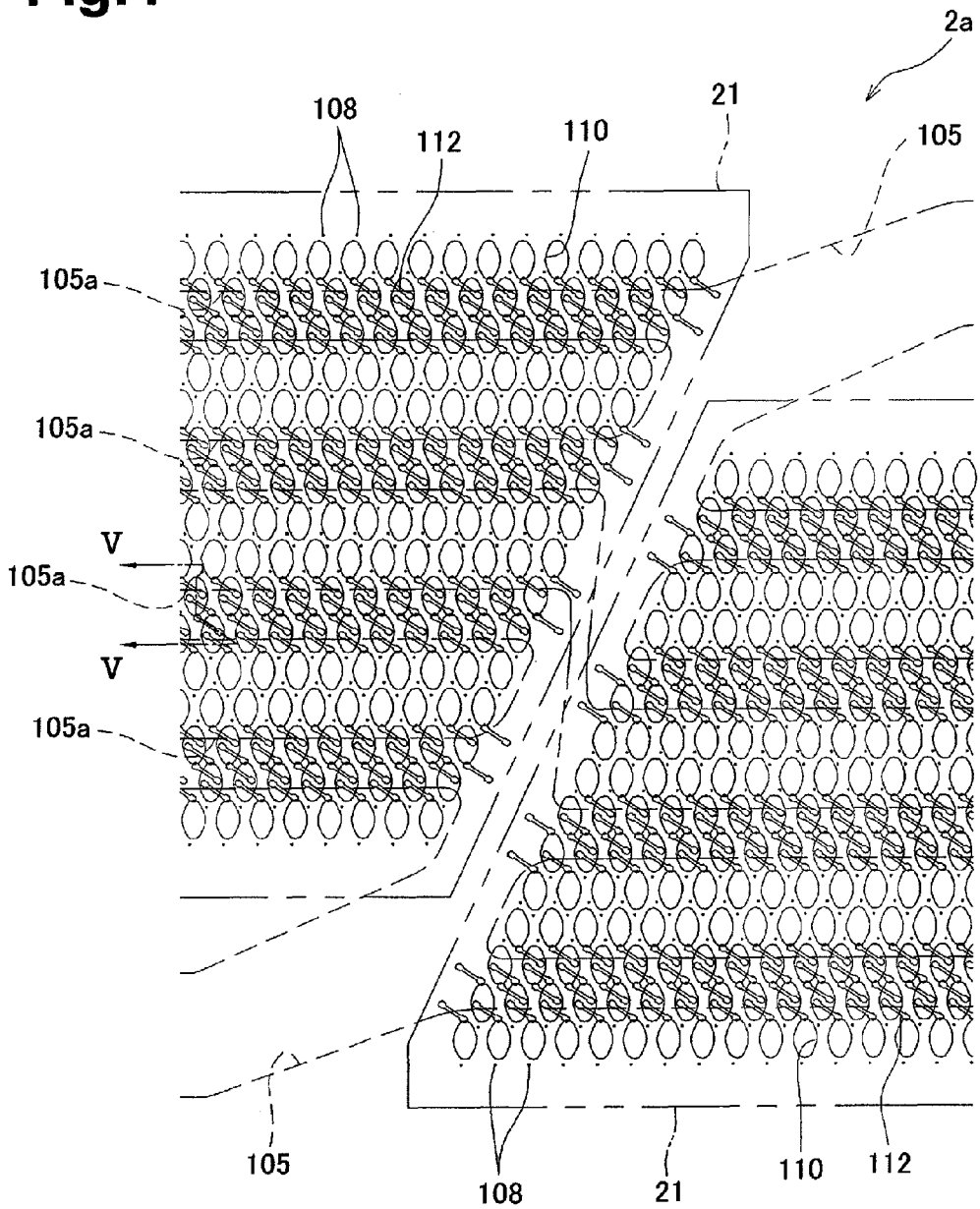
FIG. 4 is an enlarged view of a region enclosed by a dashed-line in FIG. 3.

Referring to FIG. 3, in each head body 2, a plurality of actuator units 21, e.g., four actuator units 21, may be coupled to an upper surface 9*a* of a channel unit 9. Referring to FIG. 4, each channel unit 9 may comprise ink channels with pressure chambers 110 and the like formed therein. Each actuator unit 21 may comprise a plurality of actuators, and each of the plurality of actuators may correspond to one or more of a plurality of pressure chambers 110. Each actuator may be driven by a driver IC (not shown) and selectively may apply ejection energy to the ink in the corresponding pressure chamber.

Each channel unit 9 may have a substantially rectangular-parallelepiped shape. Upper surface 9*a* of channel unit 9 may comprise a plurality of ink supply ports 105*b* corresponding to ink discharge channels (not shown) of a reservoir unit. Referring to FIGS. 3 and 4, channel unit 9 may comprise manifold channels 105, and manifold channels 105 may communicate with ink supply ports 105*b* and sub-manifold channels 105*a*, which branch off from the manifold channels 105. Ink ejection surface 2*a* may comprise a plurality of nozzle holes 108 which are arranged in a matrix and may be disposed at the lower surface of channel unit 9. A plurality of pressure chambers 110 may be arranged in a matrix in a surface of channel unit 9, to which actuator units 21 are coupled.

A plurality of rows of pressure chambers 110, e.g., sixteen rows, may be arranged in the longitudinal direction of channel unit 9 and spaced equal distances apart from one another, and each of the plurality of rows may be arranged parallel to one another in the main scanning direction. Actuator units 21 may have a substantially trapezoidal shape. The number of pressure chambers 110 in each pressure chamber row gradually may decrease from the longer-side end to the shorter-side end of actuator units 21. Nozzle holes 108 also may be arranged in similar manner.

Figure 5:
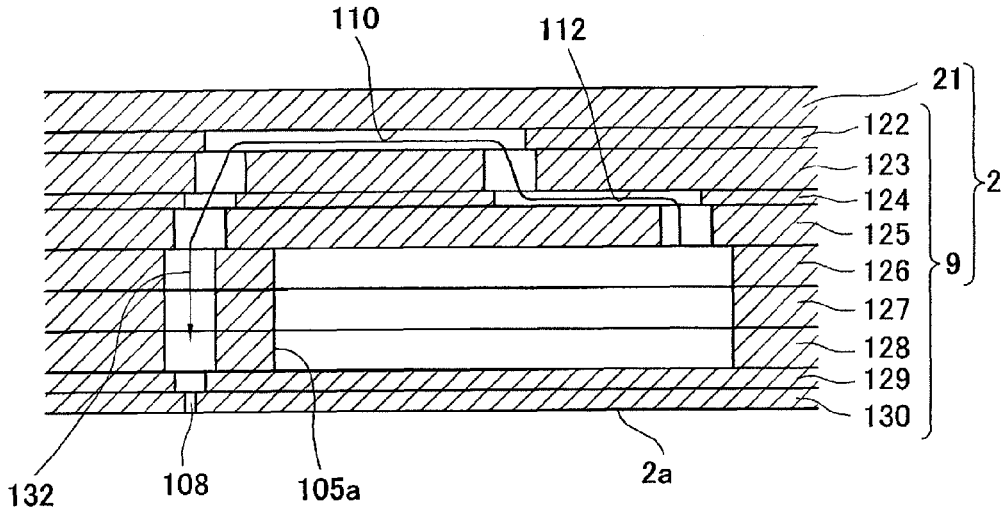
FIG. 5 is a cross-sectional view along line V-V in FIG. 4.

Referring to FIG. 5, channel unit 9 may be comprise a plurality of plates, e.g., nine plates 122 to 130, made of metal, e.g., stainless steel. Each of plates 122 to 130 may be a rectangular, flat plate elongated in the main scanning direction.

Through holes may be formed in plates 122 to 130. Through holes may be connected by aligning and stacking plates 122 to 130. Consequently, manifold channels 105, sub-manifold channels 105*a*, and multiple individual ink channels 132 extending from the outlets of sub-manifold channels 105*a* through pressure chambers 110 to nozzle holes 108 may be formed in channel unit 9. The lower surface of nozzle plate 130 may comprise nozzle holes 108 and may function as ink ejection surface 2*a*.

Ink supplied from the reservoir unit through ink supply ports 105*b* to channel unit 9 may flow from manifold channels 105 to sub-manifold channels 105*a*. The ink in sub-manifold channels 105*a* may flow in individual ink channels 132. The ink may pass through apertures 112 which may function as throttles and pressure chambers 110, before reaching nozzle holes 108.

Figure 6A:
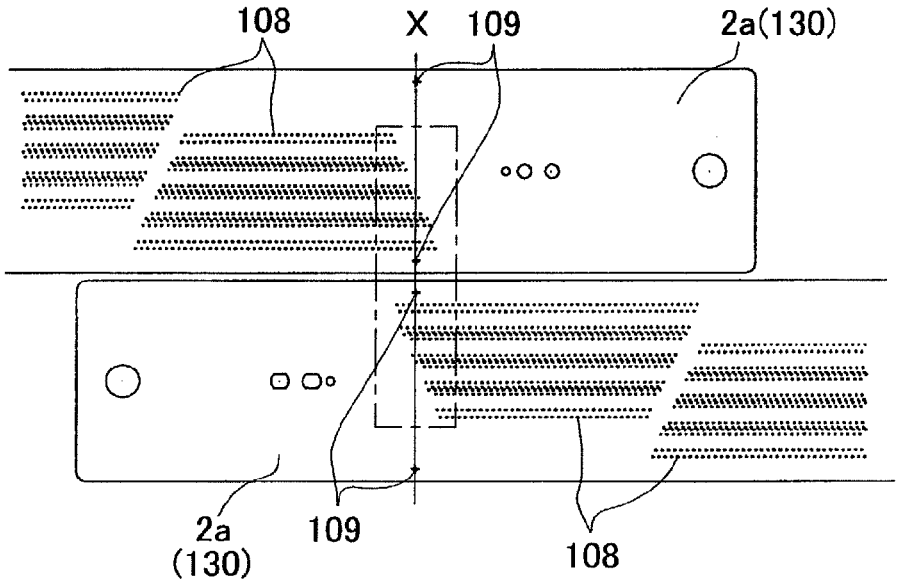
FIG. 6A is an enlarged partial view of regions in which two of the ink jet heads overlap each other according to the embodiment of FIG. 2.
Figure 6B:
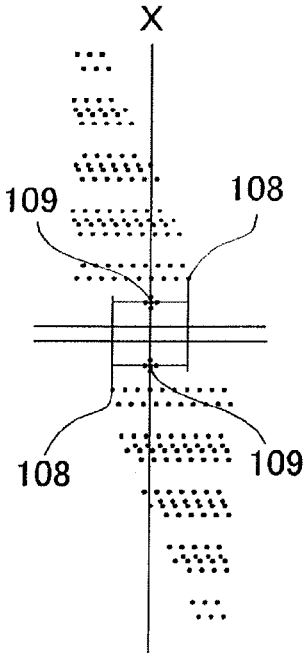
FIG. 6B is an enlarged view of a region enclosed by a dashed-line in FIG. 6A.

Referring to FIGS. 2, 6A and 6B, each nozzle plate 130 may comprise nozzle holes 108 and a plurality of positioning holes 109, e.g., four positioning holes 109. Positioning holes 109 may have the same shape as nozzle holes 108.

As shown in FIGS. 2 and 6A, two of the plurality of positioning holes 109 may be disposed near two edges of nozzle plate 130 in the sheet conveying direction. As shown in FIG. 6B, the two of the plurality of positioning holes 109 also may be disposed at the midpoint, in the main scanning direction, between two particular nozzle holes 108. Two particular nozzle holes 108 may be formed in the overlapping regions of two nozzle plates 130, adjacent to each other in the sheet conveying direction. Each of the two particular nozzle holes 108 may be one of the plurality of nozzle holes in its corresponding nozzle plate 130 and may be the nozzle hole disposed closest to the edge of its corresponding nozzle plate 130 in the main scanning direction. The other two positioning holes 109 may be arranged point-symmetrically to the aforementioned positioning holes 109 with respect to the center of the nozzle plate 130.

Each nozzle plate 130 may comprise positioning holes 109 arranged in a plurality of pairs, e.g., two pairs. The pairs of positioning holes 109 may be disposed point-symmetrically to each other with respect to the center of nozzle plate 130. One of the two pairs of positioning holes 109, e.g., the pair formed in the overlapping region, may be disposed along a straight line X, extending generally in the sheet conveying direction. In the nozzle plates 130 of two inkjet heads 1 adjacent to each other in the sheet conveying direction, positioning holes 109 formed in one nozzle plate 130 and positioning holes 109 formed in another nozzle plate 130 may be aligned along the straight line X.

Nozzle holes 108 formed in one inkjet head pair may be arranged at a pitch of 600 dpi in the main scanning direction by aligning the positioning holes 109 along the straight line X. A configuration in which nozzle holes 108 are arranged at equal distances apart in the main scanning direction may be provided even when inkjet heads 1 are arranged, such that the inkjet heads alternately reverse orientation. Therefore, the center of each nozzle plate 130 also may be the center of nozzle holes 108 formed in each inkjet head 1. In various shapes of nozzle plates 130, positioning holes 109 may be formed with respect to the center of nozzle holes 108 which are formed in each inkjet head 1. An inkjet head pair with a predetermined resolution in the main scanning direction may be provided by aligning positioning holes 109 in two nozzle plates 130 along the straight line X.

Nozzle holes 108 may be arranged to conform to the trapezoidal shape of actuator units 21. As shown in FIG. 3, the plurality of actuator units 21, e.g., four actuator units 21, may be arranged in a staggered manner in the longitudinal direction of channel unit 9. Moreover, the center of nozzle holes 108 may coincide with the center of actuator units 21.

Figure 7:
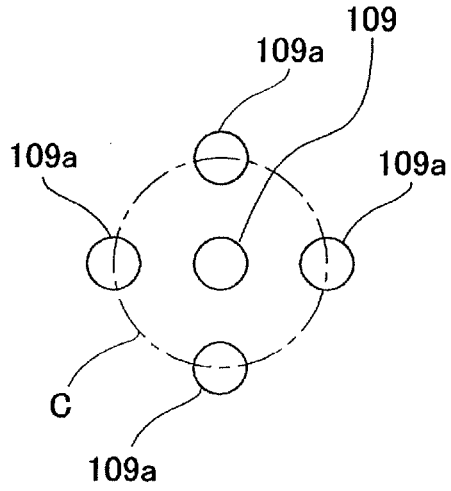
FIG. 7 is an enlarged plan view of positioning holes according to the embodiment of FIG. 2.

Referring to FIG. 7, a plurality of detection holes 109*a*, e.g., four detection holes 109*a*, with the same shape as nozzle holes 108 may be formed in a circle C centered at positioning hole 109 in nozzle plate 130. The plurality of detection holes 109*a* may be evenly spaced apart from one another in circle C. Thus, positioning holes 109 may be detected readily with reference to detection holes 109*a*.

Nozzle holes 108, positioning holes 109, and detection holes 109*a* may be formed simultaneously by a punching member of a processing machine in the fabrication process of nozzle plates 130. In the fabrication process, the relative positions of nozzle holes 108, positioning holes 109, and detection holes 109*a* may be maintained precisely.

Inkjet heads 1 may be mounted to inkjet printer 101 during an assembling process of inkjet printer 101. First, a plurality of inkjet heads 1, e.g., eight inkjet heads 1, may be attached temporarily to inkjet printer 101. Second, a high-magnification camera may determine the overlapping regions of ink ejection surfaces 2*a*, e.g., nozzle plates 130, of inkjet heads 1 adjacent to one another in the sheet conveying direction. Third, with reference to detection holes 109*a*, the positions of positioning holes 109 near the edges of ink ejection surfaces 2*a* which are adjacent to one another in the sheet conveying direction may be confirmed. Subsequently, inkjet heads 1 may be arranged, such that positioning holes 109 of adjacent ink ejection surfaces 2*a* are disposed along the same straight line X extending in the sheet conveying direction. By aligning positioning holes 109 along the same straight line X, inkjet heads 1 may be accurately and readily positioned.

Because the plurality of positioning holes 109 are arranged point-symmetrically with respect to the center of ink ejection surface 2*a*, the positional relationship of the plurality of positioning holes 109 may not change even when one or more of the plurality of inkjet heads 1 are mounted to inkjet head 1 in a reverse orientation. Thus, despite various mounting orientations, inkjet head 1 may use one type of nozzle plates 130. Accordingly, the cost of producing inkjet heads 1 for various mounting orientations may be reduced.

Two positioning holes 109 may be disposed near both edges in the width direction of nozzle plate 130 and at the midpoint, in the main scanning direction, between the particular nozzle holes 108 closest to the end edges, in the main scanning direction, of the nozzle plates 130 adjacent to each other in the sheet conveying direction. Accordingly, adjacent inkjet heads 1 may be positioned accurately with respect to one another in the sheet conveying direction by aligning the plurality of positioning holes 109.

Figure 8:
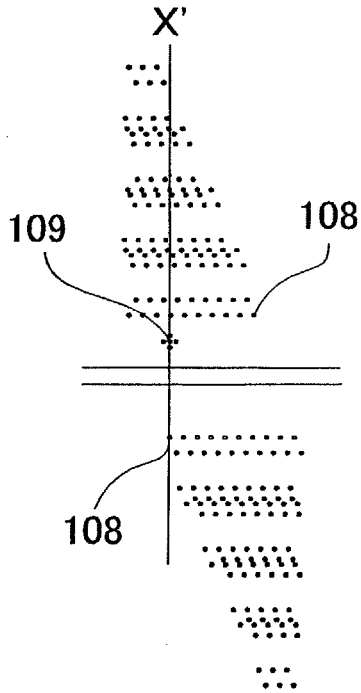
FIG. 8 is an enlarged partial view of nozzles holes and positioning holes according to another embodiment of FIG. 7.

Referring to FIG. 8, in nozzle plates 130 of two inkjet heads 1 adjacent to each other in the sheet conveying direction, a positioning hole 109 formed in one nozzle plate 130 and a particular nozzle hole 108 formed in the other nozzle plate 130 may be aligned along a straight line X' extending in the sheet conveying direction.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the scope of the invention being defined by the following claims.

What is claimed is:

1. A recording apparatus comprising:

a first recording head comprising a first nozzle plate, the first nozzle plate comprising a first plurality of nozzle holes and a first positioning hole configured to position the first recording head; and a second recording head adjacent to the first recording head in a first direction, the second recording head comprising a second nozzle plate, the second nozzle plate comprising a plurality of nozzle holes and a second positioning hole configured to position the second recording head, wherein the first positioning hole and the second positioning hole are aligned in the first direction.

2. The recording apparatus according to claim 1, wherein the first positioning hole and the second positioning hole have substantially the same shape as the nozzle holes.

3. The recording apparatus according to claim 1, wherein each recording head comprises a plurality of positioning holes, and at least one of the plurality of positioning holes is positioned point-symmetrically from another one of the plurality of positioning holes with respect to the center of the nozzle plate.

4. The recording apparatus according to claim 1, wherein the first recording head and the second recording head are arranged, such that a first overlap area of the first nozzle plate overlaps a second overlap area of the second nozzle plate in the first direction.

5. The recording apparatus according to claim 4, each nozzle plate comprising a first pair of positioning holes and a second pair of positioning holes positioned point-symmetrically from the first pair of positioning holes with respect to the center of the nozzle plate.

6. The recording apparatus according to claim 5, wherein one of the first pair of positioning holes and one of the second pair of positioning holes are aligned along a straight line extending in the first direction, wherein the straight line passes through a midpoint between a first nozzle hole disposed in the first overlap area and a second nozzle hole disposed in the second overlap area, the first and the second two nozzle holes are spaced apart from the midpoint in a second direction that is perpendicular to the first direction, and each of the first and the second nozzle holes is the nozzle hole which is closest to the edge of its corresponding nozzle plate in the second direction among the plurality of nozzle holes positioned in the corresponding nozzle plate.

7. The recording apparatus according to claim 1, further comprising at least one detection hole configured for detection of the position of the positioning holes.

8. The recording apparatus according to claims 7, wherein the at least one detection hole has substantially the same shape as the nozzle holes.

9. The recording apparatus according to claim 7, wherein a plurality of the at least one detection holes are disposed in a circle centered at each positioning hole in the nozzle plates.

10. The recording apparatus according to claim 1, wherein each plurality of the nozzle holes are arranged to form a plurality of nozzle groups, each of the plurality of nozzle groups has a trapezoidal shape, and the plurality of nozzle groups are arranged in a staggered manner in the longitudinal direction of each recording head.

11. The recording apparatus according to claim 1, wherein the first direction is a direction along which a sheet is conveyed.

12. A recording apparatus comprising a plurality of recording heads arranged adjacent to one another in a first direction, each of the recording heads comprising a nozzle plate, each nozzle plate comprising a plurality of nozzle holes and at least one positioning hole configured to position the plurality of recording heads, wherein a first positioning hole formed in a first nozzle plate of a first recording head and a second nozzle hole formed in a second nozzle plate of a second recording head adjacent to the first recording head are aligned in the first direction.

13. A recording apparatus manufacturing method comprising the steps of:

arranging a first recording head and a second recording head adjacent to the first recording head in a first direction, wherein each of the first and the second recording heads comprises a nozzle plate comprising a plurality of nozzle holes, at least one detection hole, and at least one positioning hole configured to position the recording heads;

attaching the first and the second recording heads to the recording apparatus;

determining the positions of a first positioning hole of the first recording head and a second positioning hole of the second recording head;

detecting the positions of the first and the second positioning holes with reference to the at least one detecting hole of each of the first and the second recording head;

confirming the positions of the first and the second positioning holes; and positioning the first and the second inkjet heads, such that the first and the second positioning holes are aligned in the first direction.

* * * * *